US007896139B2

(12) United States Patent
Syrman et al.

(10) Patent No.: US 7,896,139 B2
(45) Date of Patent: Mar. 1, 2011

(54) GUIDE-RAIL BRAKE

(75) Inventors: Timo Syrman, Hyvinkää (FI); Tomi Torttila, Janakkala (FI)

(73) Assignee: Kone Corporation, Helsinki (FI)

( * ) Notice: Subject to any disclaimer, the term of this patent is extended or adjusted under 35 U.S.C. 154(b) by 285 days.

(21) Appl. No.: 12/174,545

(22) Filed: Jul. 16, 2008

(65) Prior Publication Data

US 2008/0296097 A1 Dec. 4, 2008

Related U.S. Application Data

(63) Continuation of application No. PCT/FI2007/000007, filed on Jan. 10, 2007.

(30) Foreign Application Priority Data

Jan. 17, 2006 (FI) ..... 20060036

(51) Int. Cl.
*B61H 7/12* (2006.01)

(52) U.S. Cl. ..... 188/44; 188/267; 188/161; 187/288

(58) Field of Classification Search ..... 188/44, 188/267, 43, 161, 165, 171, 173; 187/287, 187/288, 289, 351, 404, 409
See application file for complete search history.

(56) References Cited

U.S. PATENT DOCUMENTS

| | | | | | |
|---|---|---|---|---|---|
| 3,705,333 | A | * | 12/1972 | Galetto et al. | 361/159 |
| 3,742,862 | A | * | 7/1973 | Gebhardt et al. | 104/284 |
| 5,141,082 | A | * | 8/1992 | Ishii et al. | 187/289 |
| 5,159,995 | A | * | 11/1992 | Sissala et al. | 187/376 |
| 5,518,087 | A | | 5/1996 | Hwang et al. | |
| 5,791,442 | A | | 8/1998 | Arnold | |
| 6,131,704 | A | | 10/2000 | Viita-Aho et al. | |

FOREIGN PATENT DOCUMENTS

| | | | |
|---|---|---|---|
| DE | 19803433 | A1 | 8/1999 |
| EP | 0488809 | A2 | 6/1992 |
| FI | 970390 | A | 7/1998 |

* cited by examiner

*Primary Examiner* — Pam Rodriguez
(74) *Attorney, Agent, or Firm* — Birch, Stewart, Kolasch & Birch, LLP

(57) ABSTRACT

A guide-rail brake (1) of an elevator and a method for controlling the brake are provided. The brake comprises a frame part fixed to the elevator car, a prong part, which contains turning jaws (3,4) that correspond to the guide rail (2) via the braking surfaces when braking, a spring (10) loading the prong part to press the braking surfaces to the guide rail, and a controllable mover, which is an electromagnet (15), which contains two pulling core pieces (17,18). The force effect of the electromagnet (15) on the prong part is opposed to the spring. In the guide-rail brake an air gap (ag) is structurally arranged between the center parts (19,20) of the pulling core pieces (17, 18) of the electromagnet of the guide-rail brake when the brake is fully energized, and a damping circuit is arranged in the coil (16) of the electromagnet (15) of the guide-rail brake to speed up operation of the guide-rail brake.

20 Claims, 3 Drawing Sheets

GUIDE-RAIL BRAKE

This application is a Continuation of copending PCT International Application No. PCT/FI2007/000007 filed on Jan. 10, 2007, which designated the United States, and on which priority is claimed under 35 U.S.C. §120. This application also claims priority under 35 U.S.C. §119(a) on Patent Application No(s). 20060036 filed in Finland on Jan. 17, 2006. The entire contents of each of the above documents is hereby incorporated by reference.

BACKGROUND OF THE INVENTION

1. Field of the Invention:

The present invention relates to a guide-rail brake and a method for controlling a guide-rail brake.

2. Background of the Invention

A guide-rail brake of a prong type that grasps the guide rail, in which compression of the braking surfaces exerted on the guide rail is achieved by means of a spring force, is very generally used a brake device. This type of brake device is often a safety apparatus to stop an upward or downward moving elevator, if the speed has become to high or for some other reason. In practice placement the brake on the elevator car, especially adding one to an existing elevator, is problematic in terms of space usage, because the brake must be quite large owing to the large forces exerted on the brake. A prong-type brake can also be the operating brake of an elevator. A prong-type operating brake has been used in e.g. linear motor elevators. Recently these type of brakes have been presented in publications U.S. Pat. No. 5,518,087 and EP 0 488 809 A2, among others. These types of brakes contain braking surfaces or brake pads on the tip of the prong, which are located at a distance from the guide rail. A spring is disposed in the prong, and the loading on the prong achieved by the spring endeavors to press the brake pads or braking surfaces against the guide rail. Preventing this endeavor is a holding device, usually an electromagnet. This or a separate electromagnet is used to open the brake. Publication FI 970390 also presents a good example of an effective guide-rail brake.

In prior-art guide-rail brakes the fixed hinging of the brake prongs causes a need to manufacture a specific brake prong for each brake size. If this is not done, a misalignment between the guide rail and the braking surfaces arises when using a guide-rail brake with a guide rail of a different thickness than that for which the guide-rail brake is intended. Owing to the misalignment the contact surface between the braking surfaces and the guide rail is reduced, so the surface pressure on the contact surface is great. Due to the great local surface pressure, the braking surfaces wear unevenly and quickly. Also wear of the guide rail increases compared to the case where the braking surfaces and guide rail surfaces are aligned. Another result of the misalignment is that uneven surface pressure is exerted on the guide rail, in which case the guide rail wears unnecessarily. The dependency of the brake on the guide rail size reduces manufacturing batch sizes and increases warehousing costs and other costs.

In prior-art brakes there is a fairly large clearance between the guide rail and the braking surface to ensure that the braking surface does not touch the guide rail when the brake is open. A result of the large clearance between the guide rail and the braking surface is a need for a large stroke length of the pulling of the magnet to open the brake, which in turn creates a need to increase the size of the magnet. The long stroke required by the large clearance also causes noise problems, because closing of the brake occurs by means of a spring. During the long stroke greater energy from the spring is exerted on the movement of the prong than would be in a short stroke. The placement of prior-art brakes is awkward, because when disposed below or on top of the elevator car they increase the overall height of the elevator car. Especially in the modernization of old elevators increasing the height of the elevator car may result in a need to lengthen the elevator shaft to ensure adequate headroom. Lengthening the elevator shaft has unfavorable cost repercussions however. Likewise substantial modification of the structure of the existing elevator car incurs considerable additional costs. Furthermore, a problem with prior-art guide-rail brakes is that their operating delay is too great, so they are only suitable for use in preventing overspeed upwards and downwards. At its fastest the delay may be e.g. approx. 500 ms and in that case it is possible that brakes according to prior art do not release at all owing to remanence and thus the brake device does not operate at all. The delay is often too long and the distribution of the delays of the different braking devices of the elevator is large. When the load is over 1000 kg and two guide-rail brakes are used, the distribution in delays means these devices operate at different times. A further problem is that guide-rail brakes according to prior art do not necessarily give full braking force immediately they are released, because residual magnetism causes a counterforce.

SUMMARY OF THE INVENTION

In order to overcome the aforementioned problems and to achieve a better guide-rail brake a new type of guide-rail brake is presented as an invention. The purpose of the invention is to achieve a guide-rail brake construction suitable for the most general different applications. The purpose of the invention is, on the one hand, to speed up operation of the guide-rail brake and especially to speed up the operating delay of the guide-rail brake. On the other hand, the purpose of the invention is to achieve a guide-rail brake, which is suitable for use in preventing creepage of the elevator car away from the landing. One aim is also to achieve an operationally reliable guide-rail brake. The guide-rail brake according to the invention is characterized by what is disclosed in the claims and the method according to the invention is characterized by what is disclosed in the claims. Other embodiments of the invention are characterized by what is disclosed in the claims. Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts.

The advantages that can be achieved with the invention include the following:

The brake is operationally reliable and relatively lightweight. The guide-rail brake of the invention is suitable for use in different elevators and in different applications. The guide-rail brake according to the invention is simple in terms of its assembly, and has a clear construction and few separate parts, so it is also inexpensive to manufacture. A small movement of the jaws of the prong and, further, a small size of the coil and coil core of the electromagnet needed to open the brake and to keep the brake open is attained, because the air gap is short. In the guide-rail brake according to the invention an air gap between the center parts of the pulling cores ensures that residual magnetism does not prevent operation of the brake device and that the release delay of the guide-rail brake is short. The guide-rail brake according to the invention is operationally reliable and it can be used as a brake for preventing creepage of the elevator car away from the landing. In the guide-rail brake according to the invention the release delay of the brake is substantially shorter than in prior-art brakes and the distribution of the operating delay among the different devices of the elevator is smaller, so the elevator is more operationally reliable. In addition, full braking force with the guide-rail brake is achieved more quickly by connecting a damping circuit to the coil of the guide-rail brake. The residual magnetism opposing the braking force in the guide-rail brake of the invention can be inexpensively and sometimes totally eliminated.

A significant advantage is that the force of the same prong, in which the distance of the jaws of the prong can be set, can be changed by varying the rigidity of the loading spring and the size of the magnet. Thus a single prong structure and prong dimensioning is suited to guide rails of numerous different thicknesses and to numerous loads of different magnitude.

By locating an air gap between the center parts of the pulling core of the electromagnet inside the coil leakage flux inside the iron circuit is reduced and magnetic flux passes better via the pulling air gap. This achieves better efficiency in relation to the pulling force and holding force, which in turn helps allow lightening of the structure. The coil body of the coil can be used to control the movement of the iron core in pulling, which saves parts and weight. The brake according to the invention does not in practice increase the height of the elevator car, because the guide shoe of the elevator can be integrated into it. Since the normal aim 1s to position the upper car guides and lower car guides of the elevator at a distance from each other on the top corners and bottom corners of the elevator car or the car sling, so that fairly small guide forces are attained, a guide shoe integrated into the brake does not increase the height of the car. Owing to the integrated guide, a situation in which a brake later retrofitted to an elevator as an accessory would hamper servicing of the guide shoe of the elevator. Although in new elevators the fixing of the brake to the elevator could be planned so that positioning of the brake did not hamper servicing of the guide, e.g. replacement of a guide pad, integration of the brake and the guide shoe results in a saving in manufacturing costs.

The guide-rail brake according to the invention can be supported on the elevator car flexibly in the vertical direction also and in addition measurement of the vertical force is arranged in conjunction with the support of the prong part of the guide-rail brake. By means of this arrangement e.g. an elevator load weighing function can be implemented and/or the data produced by measurement can be utilized in preparing the elevator to start moving.

The guide-rail brake according to the invention is suited for use as such with guide rails of different thicknesses owing to the distance adjustment of the hinges of the jaws of the prong. Due to the distance adjustment of the hinges a misalignment between the guide rail and the braking surface can be avoided, in which case the brake wears the guide rail less and is also less prone to wear. Due to the compact structure of the brake, the integration of functions and the fairly low number of brake parts, the safety gear is very durable.

In the guide-rail brake applicable to the invention the directions of the support forces of the hinging of the jaws of the prong exerted on the jaws of the prong remain essentially the same in the closing movements and the opening movements of the brake. Thus the clearances in the hinging do not change side between opening and closing of the brake, in which case there is a saving in the stroke length of the magnet opening the brake and the opening movements and closing movements are more precise. Likewise impacts and hinge wearing caused by a change of side are avoided.

An important advantage is that the same basic structure of the guide-rail brake is suitable for use as an operating brake and also as an emergency brake of an elevator as well as a brake for preventing creepage of the elevator car away from the landing. Emergency brake usage is important because conventionally a safety gear is used as an emergency brake that grips the guide rail of the elevator. The safety gears conventionally used operate only by braking the downward movement of the elevator car. It is simple to control the guide-rail brake according to the invention to stop movement in the upward direction also. When a guide-rail brake is an emergency brake it is normal to make the braking surfaces machined for the guide rail so that in brakings, which occur relatively infrequently, a proper grip on the guide rail is assured and the braking force is large. When a guide-rail brake is an operating brake stopping can be effected with the drive device of the elevator, which can be e.g. a conventional rope hoisting machine, a linear motor or a drive machine located on the elevator car and acting on the elevator guide rail.

The guide-rail brake of an elevator according to the invention comprises a frame part fixed to the elevator car, and a prong part, which contains turning jaws that correspond to the guide rail via the braking surfaces when braking. It additionally comprises a spring loading the prong part to press the braking surfaces to the guide rail and a controllable mover, which is an electromagnet, which electromagnet preferably contains at least two pulling core pieces, and the force effect of which electromagnet on the prong part is opposed to the spring. Additionally an air gap is structurally arranged between the center parts of the pulling core pieces of the electromagnet of the guide-rail brake when the brake is fully energized. In addition to this a damping circuit is arranged in the coil of the electromagnet of the guide-rail brake to speed up the operation of the brake.

In the method according to the invention for controlling the guide-rail brake of an elevator, which guide-rail brake comprises a frame part fixed to the elevator car, and a prong part, which contains turning jaws that correspond to the guide rail via the braking surfaces when braking, a spring loading the prong part to press the braking surfaces to the guide rail, a controllable mover, which is an electromagnet, which electromagnet contains two pulling core pieces, the force effect of which electromagnet on the prong part is opposed to the spring, an air gap is structurally arranged between the center parts of the pulling core pieces of the electromagnet when the brake is fully energized. Additionally in the method a damping circuit is arranged in the coil of the electromagnet of the guide-rail brake to speed up the operation of the brake.

BRIEF DESCRIPTION OF THE DRAWINGS

In the following, the invention will be described in more detail by the aid of some examples of its embodiments, which in themselves do not limit the scope of application of the invention, with reference to the attached drawings, wherein.

DETAILED DESCRIPTION OF THE PREFERRED EMBODIMENTS

Figure 1:
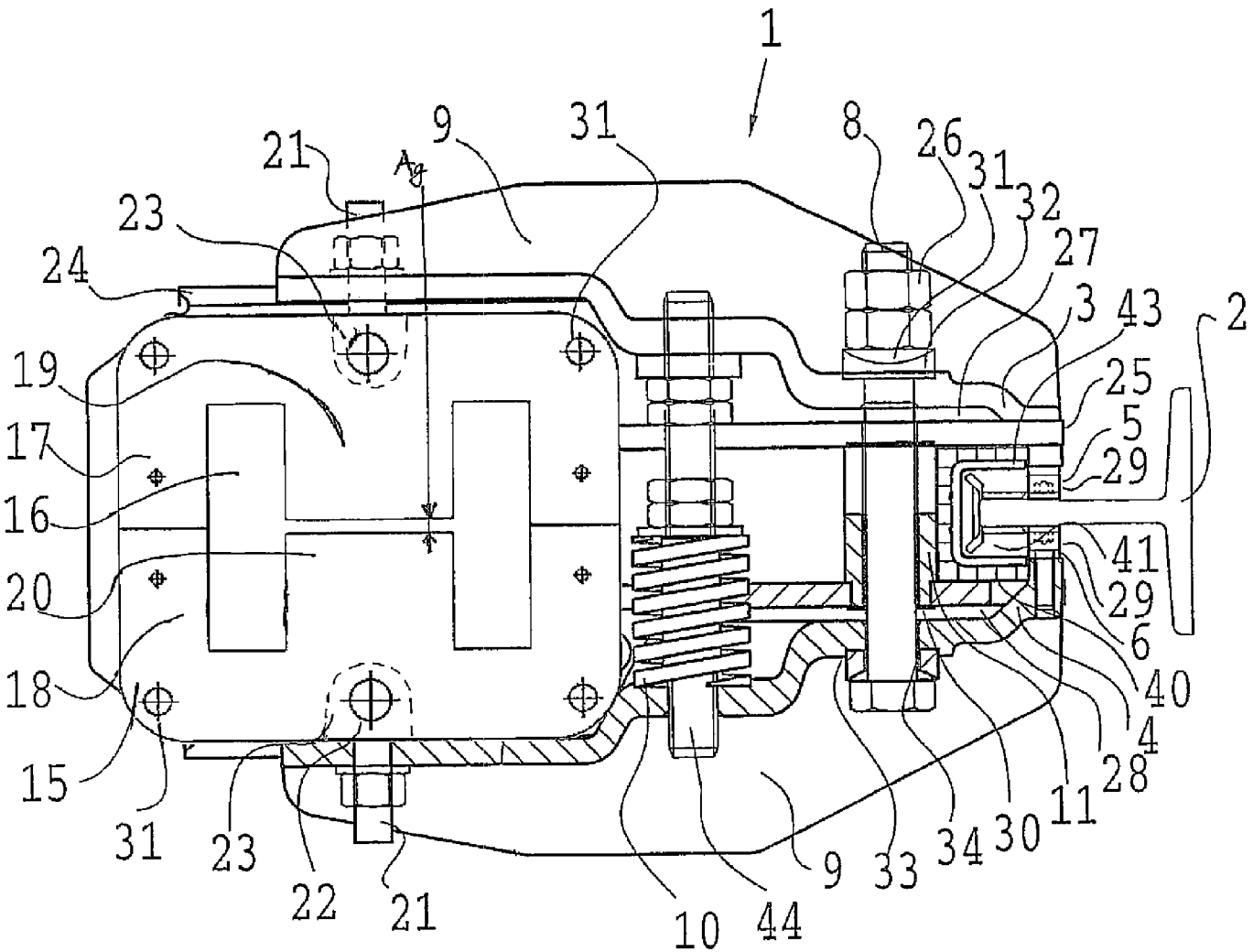
FIG. 1 presents a top view of a guide-rail brake according to the invention.

FIG. 1 presents a top view of a guide-rail brake applicable to the invention. In FIG. 1 the guide rail 2 is seen between the brake pads 5,6 fastened to the jaws 3,4 of the prong of the brake. The jaws 3,4 are hinged to each other by means of the bolts 7,8. The bolt 7 is not presented in FIG. 1 for the sake of clarity. The jaws 3,4 are stiffened with ribbing 9. The spring 10 loads the jaws pressing the jaws 3,4 further apart from each other, in which case the brake pads 5,6 compress against the guide rail 2, because the jaws are hinged between the brake pads 5,6 and the spring 10 by means of the bolts 7,8 so that the jaws cannot move apart from each other at the location of the bolts. The spring 10 is guided by the center pin 44.

The guide-rail brake 1 is opened and held open by means of a power element 15, which is preferably a magnet, that achieves a controllable movement. Control of the magnet or other mover can occur as commanded by the elevator control with a separate operating device or operating switch. Braking can also be achieved e.g. as triggering of the overspeed governor from overspeed of the elevator. Braking as triggering of the overspeed governor is started when the overspeed causes operation of the switch in the overspeed governor. The switch disconnects the power supply of the electromagnet that is the power device of the guide-rail brake, whereupon the force of the electromagnet holding the brake open ceases and the brake pads press against the guide rail.

The magnet contains a coil 16 and a pulling core formed of two parts 17,18. The parts 17, 18 forming the pulling core are preferably made from stacking essentially E-shaped plate pieces, in which case it is possible to assemble pulling cores of different sizes by stacking a different amount of E-shaped pieces. The stacks of plate pieces are bunched together with bolts 31 or with other suitable means. To avoid eddy current disadvantages it is good to insulate the plate pieces of the pulling cores from each other, if the magnets are controlled by alternating-current electricity. If the coil of the magnet is controlled by direct-current electricity, the pulling cores can be made as solid iron pieces. A preferred method of controlling the magnet is to use a larger current when opening the brake and a smaller current when holding the brake open. The center arm of the E-shaped pieces of the pulling core extends inside the coil and the other arms to outside the coil. The centre arms remaining inside the coil form the center parts 19,20 of the pulling core pieces. Between the center parts 19, 20 of the parts 17, 18 of the pulling core is an air gap Ag. The air gap Ag is dimensioned in the situation in which the magnet is fully energized, in other words in the situation in which the brake is open and current is supplied to the electromagnet, in which case the pulling core pieces 17,18 are fully in contact with each other and owing to the structure of the pulling core pieces an air gap Ag of the desired magnitude occurs between the center pieces 19,20. An air gap is achieved between the center parts of the pulling core pieces either by means of the shape of the pulling core pieces or otherwise by positioning additional pieces or a support element between the endmost E-arms of identical pulling core pieces or by another method suited to the purpose. The air gap is preferably between 0-1 mm in magnitude. In practice, however, when the air gap is less than 0.2 mm it has only a minor effect on the operating delay and on the residual magnetism of the guide-rail brake. If, on the other hand, the air gap is over 1 mm the attraction between the core pieces of the magnet declines and the achievable advantages are lost and other phenomena affecting the operation of the guide-rail brake occur, as a result of which different components might be needed for the brake. A very much preferred air gap is between 0.3 . . . 0.8 mm and the magnitude of the most preferred air gap is 0.5 mm, with which the achievable advantages of the invention are achieved by means of the most preferred invention. When the magnet core is manufactured from plates such that the plates are compressed together with some fixing element such as with a bolt, the fact that the actual air gap may grow to be larger than the value defined in manufacturing must also be taken into account in the dimensioning of the air gap. This arises from e.g. the length difference of the plates, which results in the surface of the air gap not being even. If in the manufacturing the plate stacks are set for a distance of e.g. 0.2 mm, the air gap of some of the plates in the area remains larger than this, and thus the actual effective air gap also remains larger. It is ensured with the air gap Ag that residual magnetism does not prevent the guide-rail brake from operating and that the operating delay of the guide-rail brake is shorter. The actual pulling air gap 19 is inside the coil 16. The magnet 15 is fixed to the jaws 3,4 with eyebolts 21 and bolts 22. In order to save the length, the joint between the eyebolt and the pulling core is positioned in the recess 23 in the pulling core. This structure allows a small movement of the pulling core 17,18 in relation to the jaws 3,4 of the prong. The coil 16 is preferably a winding around a hollow coil core. The coil core is a tubular piece often rectangular in its cross-section, especially when the pulling core of the magnet is assembled from plate parts, which in the finished magnet is disposed around the center arm of the E-shapes of the pulling core pieces. In the case of a pulling core of solid iron, a round cross-sectional shape of the pulling core may be preferable. This coil core can be used as a guide for the moving pulling core pieces. Since the coil core is conventionally a plastic piece it is preferable, especially in the case of an operating brake, to connect the different sliding surfaces to the coil core or to otherwise make the coil core more resistant to wear.

The guide-rail brake is fixed to the elevator car or to the car sling of the elevator car by its stand 24, on which the frame 25 of the guide-rail brake 1 is fastened. The frame 25 contains bushings 11,12, which function as guides for the bolts 7,8 in the floating of the brake. The bushings also for their part stiffen the frame 25 in its connection of parts of the frame. A structure is used as the hinge of the prongs in which the jaws of the prongs are supported outwards on the ball washers 31, which keep the bolts 7,8 and the nuts 26 fastened to the bolts in their position and which are at a distance from each other, of the corresponding conical rings 32. A washer provided with a concave spherical surface can also be a substitute for a cheaper conical ring. The conical rings 32 are positioned in the machined recesses 33 in the jaws 3,4 of the prong of the guide-rail brake 2, and the bolt 7,8 fixes the structure via the hole 34 in the base of the conical rings. Between the hole 34 and the bolt 7,8 is a clearance, in which case the turning in relation to the jaw 3,4 necessary for the operation of the hinge of the bolt is not prevented. The distance is selected such that a sum clearance sufficient for floating remains between the frame 25 and the jaws 3,4, which sum distance comprises the constituent clearances 27 and 28. This sum clearance is the play of the guide-rail brake, within the scope of which the guide-rail brake floats in the horizontal direction.

The vertical force caused by the braking in the guide-rail brake 1 is supported on the frame 25. Support occurs in such a way that the jaws 3,4 are able slightly to both turn in the vertical plane and to move, owing to the clearances of the floating suspension between the jaws and the frame, in which case the jaws are able to correspond to the downwardly directed surfaces or the upwardly directed surfaces in the frame 25. The upwardly directed surfaces and the downwardly directed surfaces are located near the tips of the jaws 3,4 that grip the guide rail 2 below the jaw of the upwardly directed surfaces and above the jaw of the downwardly directed surfaces. The vertical movement of the jaws allowed by the clearances of the floating suspension is greater than the greatest vertical movement allowed by the clearances between the downwardly directed surfaces or the upwardly directed surfaces and the jaws 3,4. Thus the jaws are always supported either on the downwardly directed surfaces or on the upwardly directed surfaces before the clearances of the floating suspension are used, in which case braking does not stress the floating suspension.

Fastened to the frame 25 between the jaws 3,4 is a guide shoe 43, which is isolated from the frame 25 with a flexible, e.g. made of rubber, damping piece 40. The guide pads 41 of the guide shoe correspond to the guide rail 2 in three directions. The guide-rail brake thus surrounds the guide shoe that is built onto the same footing as the guide-rail brake. This kind of nested construction does not add height and the guide-rail brake and the guide shoe are accommodated in essentially the same height as would the guide-rail brake or the guide shoe singly. The guide pads of the guide shoe can be simply changed by threading them in from the direction of the end of the guide shoe. In the vertical direction the guide pad 41 is supported in its position by means of a locking piece 42, in which case the footing 24 prevents movement of the guide pad 41 in one vertical direction and the locking piece 42 in the other vertical direction.

The horizontal position of the prong of the guide-rail brake 1 is controlled from the guide rail with the guide pads 29. The guide pads 29 are disposed in the prong on both jaws 3,4 either in connection with the brake pads 5,6 or separately from the brake pad/braking surface. The sum clearance between the braking surfaces and the guide rail is greater than between the guide pads and the guide rail. When controlling the position of the prong the guide pads follow the guide rail 2 at least on one side with a relatively light force that is definitely smaller than the compression of the prong during braking thus keeping the prong of the brake essentially centered in relation to the guide rail. The guide pads 29 on both sides of the most preferred guide rail 2 correspond all the time to the guide rail, in which case control is continuous. In continuous control it is easy to attain a very small clearance, even of a magnitude of appreciably less than one millimeter, between the guide rail 2 and the braking surface. In the guide pads 29 is a revertive compressible structure, so that in braking the guide pads do not prevent the braking surfaces from meeting the guide rail nor the compression of the prong on the guide rail. In order to lighten the floating it is preferable to use sliding bearings 30 in the bushings 11,12 in reducing the force that is needed in the control and which is exerted on the guide pads 29 of the guide rail 2.

Figure 2:
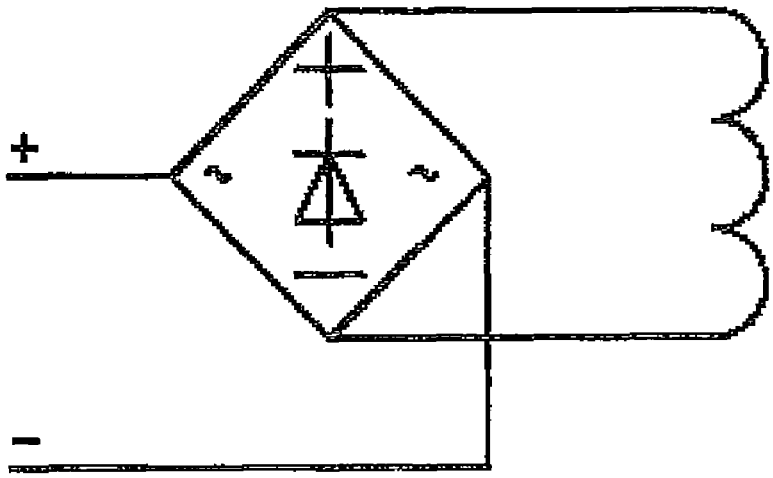
Fig 2. (Prior art)
FIG. 2 presents a diagrammatic view of the winding of a prior-art guide-rail brake.
Figure 3:
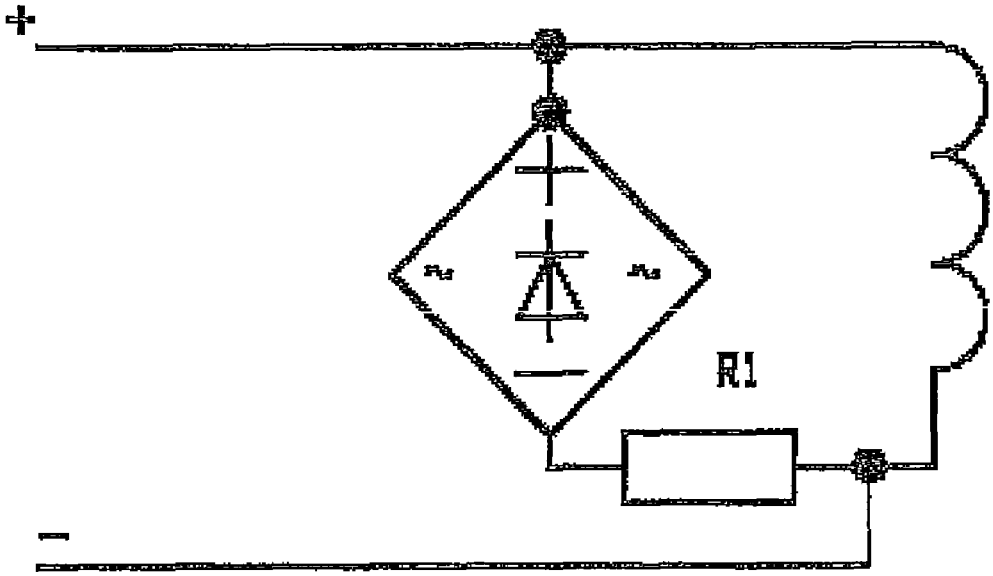
FIG. 3 presents one damping circuit of the winding of a guide-rail brake according to the invention.
Figure 4:
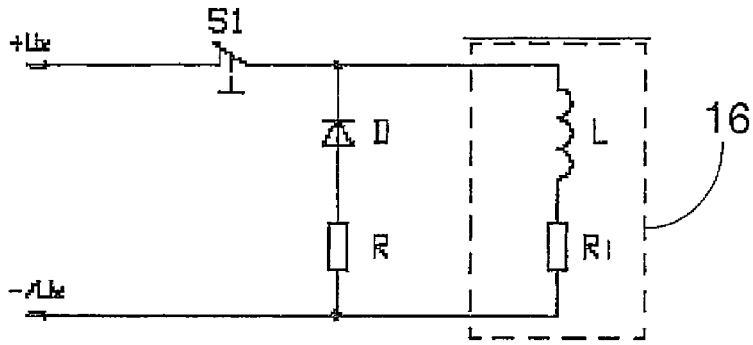
FIG. 4 presents a second damping circuit of the winding of a guide-rail brake according to the invention.
Figure 5:
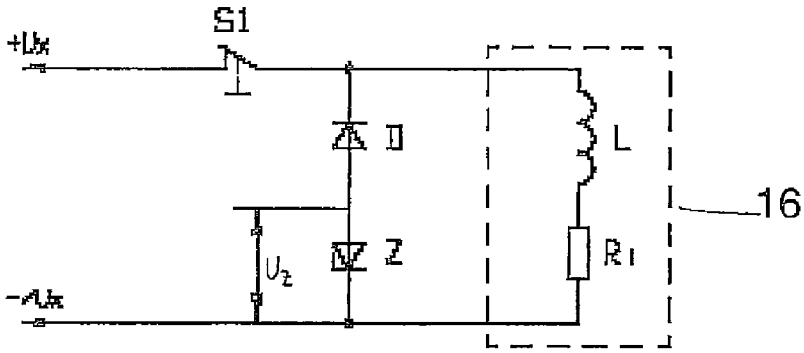
FIG. 5 presents a third damping circuit of the winding of a guide-rail brake according to the invention and FIG. 6 presents a fourth damping circuit of the winding of a guide-rail brake according to the invention.
Figure 6:
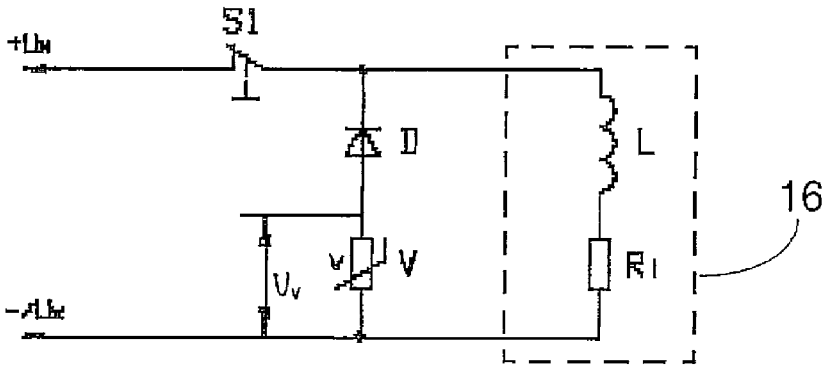

FIG. 2 diagrammatically presents the winding of a coil of a prior-art guide-rail brake. In FIGS. 3,4,5 and 6 a damping circuit has been added to the coil of the guide-rail brake in the guide-rail brake according to the invention. These figures present different embodiments of damping circuits. In FIG. 3 a resistor R1 is connected in series with the winding of the coil. In FIG. 4 the damping circuit is implemented by means of at least one resistor R and at least one diode D is connected in parallel with the winding 16 of the guide-rail brake. In FIGS. 4,5 and 6, L describes the inductance of the winding, $R_i$ describes the resistance of the winding and S1 the switch controlling the circuit, such as e.g. the switch of an overspeed governor. In the figures D is the diode of the damping circuit. In FIG. 5 the damping of the winding 16 is implemented by means of at least one zener diode Z and at least one diode D. In FIG. 6 the damping circuit of the winding 16 is implemented by means of at least one Varistor V and at least one diode D. The dimensioning of the damping circuits and the components used in them is implemented in a manner that in itself is prior art according to prior-art technology. In the guide-rail brake the full braking force of the guide-rail brake is achieved more quickly by means of the damping circuit connected to the coil. The different connections of the damping circuits can be implemented in a corresponding manner to that presented in the examples presented in FIGS. 3,4,5 and 6 or by using the same components and connecting them with the winding of the guide-rail brake either in series or in parallel in a manner suited to the purpose.

It is obvious to the person skilled in the art that the invention is not limited solely to the examples described above, but that it may be varied within the scope of the claims presented below. Thus, for example, it is obvious that the brake can correspond to the guide rail via the braking surfaces formed directly on the jaws instead of the braking surfaces in the different brake pads.

The invention claimed is:

1. A guide-rail brake of an elevator, comprising:

a frame part fixed to the elevator car, a prong part, which contains turning jaws that correspond to the guide rail via the braking surfaces when braking, a spring loading the prong part to press the braking surfaces to the guide rail, a controllable mover, which is an electromagnet, the electromagnet containing two pulling core pieces, the force effect of the electromagnet on the prong part being opposed to the spring, wherein the pulling core pieces are structurally configured to be in contact with each other and provide an air gap arranged between center parts of the pulling core pieces of the electromagnet of the guide-rail brake when the brake is fully energized, and wherein a damping circuit is arranged in the coil of the electromagnet of the guide-rail brake to speed up operation of the guide-rail brake.

2. The guide-rail brake according to claim 1, wherein the effective air gap between the center parts-of the pulling cores is greater than approx. 0.2 mm and at most approx. 1.0 mm.

3. The guide-rail brake according to claim 2, wherein the damping circuit of the coil of the electromagnet of the brake is implemented with at least one resistor and/or with at least one diode connected in series or in parallel with the winding of the coil of the guide-rail brake.

4. The guide-rail brake according to claim 2, wherein the damping circuit of the coil of the electromagnet of the brake is implemented with at least one zener diode and/or with at least one diode connected in series or in parallel with the winding of the coil of the guide-rail brake.

5. The guide-rail brake according to claim 2, wherein the damping circuit of the coil of the electromagnet of the brake is implemented with at least one varistor and/or with at least one diode connected in series or in parallel with the winding of the coil of the guide-rail brake.

6. The guide-rail brake according to claim 2, wherein the pulling core pieces of the electromagnet of the guide-rail brake are E-shaped and structurally supported so that the air gap is located between the center parts of the pulling core pieces.

7. The guide-rail brake according to claim 1, wherein the effective air gap between the center parts of the pulling cores is between 0.3- 0.8 mm, preferably approx. 0.5 mm.

8. The guide-rail brake according to claim 7, wherein the damping circuit of the coil of the electromagnet of the brake is implemented with at least one resistor and/or with at least one diode connected in series or in parallel with the winding of the coil of the guide-rail brake.

9. The guide-railGuide rail brake according to claim 7, wherein the damping circuit of the coil of the electromagnet of the brake is implemented with at least one zener diode and/or with at least one diode connected in series or in parallel with the winding of the coil of the guide-rail brake.

10. The guide-rail brake according to claim 7, wherein the damping circuit of the coil of the electromagnet of the brake is implemented with at least one varistor and/or with at least one diode connected in series or in parallel with the winding of the coil of the guide-rail brake.

11. The guide-rail brake according to claim 7, wherein the pulling core pieces of the electromagnet of the guide-rail brake are E-shaped and structurally supported so that the air gap is located between the center parts of the pulling core pieces.

12. The guide-rail brake according to claim 1, wherein the damping circuit of the coil of the electromagnet of the brake is implemented with at least one resistor and/or with at least one diode connected in series or in parallel with the winding of the coil of the guide-rail brake.

13. The guide-rail brake according to claim 12, wherein the pulling core pieces of the electromagnet of the guide-rail brake are E-shaped and structurally supported so that the air gap is located between the center parts of the pulling core pieces.

14. The guide-rail brake according to claim 1, wherein the damping circuit of the coil of the electromagnet of the brake is implemented with at least one zener diode and/or with at least one diode connected in series or in parallel with the winding of the coil of the guide-rail brake.

15. The guide-rail brake according to claim 1, wherein the damping circuit of the coil of the electromagnet of the brake is implemented with at least one varistor and/or with at least one diode connected in series or in parallel with the winding of the coil of the guide-rail brake.

16. The guide-rail brake according to claim 1, wherein the pulling core pieces of the electromagnet of the guide-rail brake are E-shaped and structurally supported so that the air gap is located between the center parts of the pulling core pieces.

17. The guide-rail brake according to claim 16, wherein the pulling core pieces are supported with separate supporter elements to form the air gap between the center parts of the pulling core pieces.

18. The guide-rail brake according to claim 1, wherein the guide-rail brake is supported flexibly in the vertical direction.

19. The guide-rail brake according to claim 1, wherein measurement of vertical force is arranged in connection with the support of the prong part.

20. A method for controlling a guide-rail brake of an elevator, the guide-rail brake comprising a frame part fixed to the elevator car, a prong part, which contains turning jaws that correspond to the guide rail via the braking surfaces when braking, a spring loading the prong part to press the braking surfaces to the guide rail, and a controllable mover, which is an electromagnet, which contains containing two pulling core pieces, the force effect of the electromagnet on the prong part being opposed to the spring, the method comprising:

fully energizing the brake such that the pulling core pieces are in contact with each other and provide an air gap between center parts of the pulling core pieces of the electromagnet; and arranging a damping circuit in the coil of the electromagnet of the guide-rail brake to speed up operation of the brake.

* * * * *